US005341952A

United States Patent [19]

Goglio

[11] Patent Number: 5,341,952

[45] Date of Patent: Aug. 30, 1994

[54] RIGID CONTAINER FOR INTERCHANGEABLE FLEXIBLE PACKS

[76] Inventor: Luigi Goglio, Via Frua, 11-20146, Milano, Italy

[21] Appl. No.: 64,652

[22] Filed: May 21, 1993

[30] Foreign Application Priority Data

May 29, 1992 [IT] Italy ..... MI92U000546

[51] Int. Cl.[5] ..... B65D 5/42

[52] U.S. Cl. ..... 220/408; 220/402; 220/404; 229/125.09; 229/125.13

[58] Field of Search ..... 220/402–404, 220/408, 410, 413, 430, 431, 908; 229/125.13, 125.09, 125.27

[56] References Cited

U.S. PATENT DOCUMENTS

| | | | |
|---|---|---|---|
| 2,352,503 | 6/1944 | Walton | 220/404 |
| 3,119,543 | 1/1964 | Walker | 220/404 |
| 3,184,100 | 5/1965 | Thomas | 220/404 |
| 3,653,362 | 4/1972 | Davis | 220/404 |
| 3,776,408 | 12/1973 | Wald | 220/404 |
| 3,944,127 | 3/1976 | Bruke et al. | 220/404 |
| 4,109,822 | 8/1978 | Egli | 220/404 |
| 4,444,355 | 4/1984 | Cary | 220/404 |
| 4,560,085 | 12/1985 | Von Hofe et al. | 220/404 |
| 4,892,224 | 1/1990 | Graham | 220/404 |
| 4,948,266 | 8/1990 | Bencic | 220/404 |

FOREIGN PATENT DOCUMENTS

| | | | |
|---|---|---|---|
| 50069 | 4/1982 | European Pat. Off. . | |
| 252039 | 1/1988 | European Pat. Off. . | |
| 522326 | 1/1993 | European Pat. Off. . | |
| 3434002 | 3/1986 | Fed. Rep. of Germany . | |
| 4108254 | 9/1992 | Fed. Rep. of Germany | 220/402 |
| 91001770 | 6/1991 | Italy . | |
| WO9216439 | 10/1992 | PCT Int'l Appl. . | |

*Primary Examiner*—Gary E. Elkins

*Attorney, Agent, or Firm*—Wegner, Cantor, Mueller & Player

[57] ABSTRACT

A rigid container for interchangeable flexible packs including an interchangeable flexible pack and a substantially parallelepiped-shaped box that includes an upper edge that includes a plurality of structures for supporting the interchangeable flexible pack and a plurality of structures for blocking the interchangeable flexible pack and a closable lid. The interchangeable flexible pack has a parallelepiped-shape that will fit in the box and includes a plurality of structures for engaging with the structure for supporting and the structure for blocking.

19 Claims, 2 Drawing Sheets

FIG. 1

RIGID CONTAINER FOR INTERCHANGEABLE FLEXIBLE PACKS

DESCRIPTION

The present invention refers to a rigid container for interchangeable flexible packs, in particular vacuum or gas compensated packs for products in powder form, such as coffee and the like.

Various types of packs exist on the market for the above purposes.

Those most widely used for preserving vacuum packed powder products are of a flexible type and do not maintain their shape after opening (they become limp), with the obvious drawbacks involved.

There are also rigid packs, consisting, for example, of metallic containers, which, however, are rather expensive, having considerable influence on the total cost of the pack of product.

In some cases, such rigid metallic containers are designed for re-use, by emptying the contents of a refill pack into them.

As well as the practical disadvantage of having to empty the refill pack each time, with the possible loss of some of the product, this involves the additional drawback of the product in the refill pack always having to come into physical contact with the same container, causing problems of a hygienic nature.

The aim of the present invention is to eliminate the above-mentioned drawbacks, by providing a rigid container for flexible packs, at a very low cost, which will have very little influence on the cost of the pack of product, and which will be able to be re-used for packs of the same type.

The container according to the invention consists of a parallelepiped-shaped box, open at the top, where conveniently a lid for closing is foreseen, and having near its upper edge means suitable for supporting a pack of product, particularly a vacuum pack of product in powder form, which maintains a well-defined outline, and which, therefore, can easily be inserted into the container.

Preferably, the pack of product has a rectangular frame at the top protruding from its perimeter, in such a way that it can be supported by the said means foreseen on the container, which preferably consists of at least one pair of opposed tabs protruding inside the container. Preferably, at a higher level than the said support tabs, other tabs are foreseen with a smaller depth, which are passed over by the frame of the pack in the insertion phase of the latter, and which serve to restrain the pack, preventing it from coming out accidentally.

Conveniently the packs which can be housed in the container according to the invention are of the type of those described in the Italian Patent application No. MI 91 A 001770 of Jun. 27, 1991 in the name of the same applicant, in which the sole upper frame, closed by a peel-off diaphragm, is foreseen, instead of the two plates, one for the base and the other for the cover.

The container cover is preferably hinged to the top of the container, and has an inner perimetral annular seat in which the upper perimetral edge of the container is positioned in the closing phase. Conveniently, a gasket is housed in such seat of the lid, to realize a perfectly tight-seal, the blocking of the lid into the closing position on the container being guaranteed by engaging teeth.

Further characteristics of the invention will be made clearer by the detailed description given below, which refers to one of its purely exemplary, and therefore not restrictive, embodiments.

BRIEF DESCRIPTION OF THE DRAWINGS

These and other aspects of the invention are illustrated in the appended drawings, in which.

Figure 1:
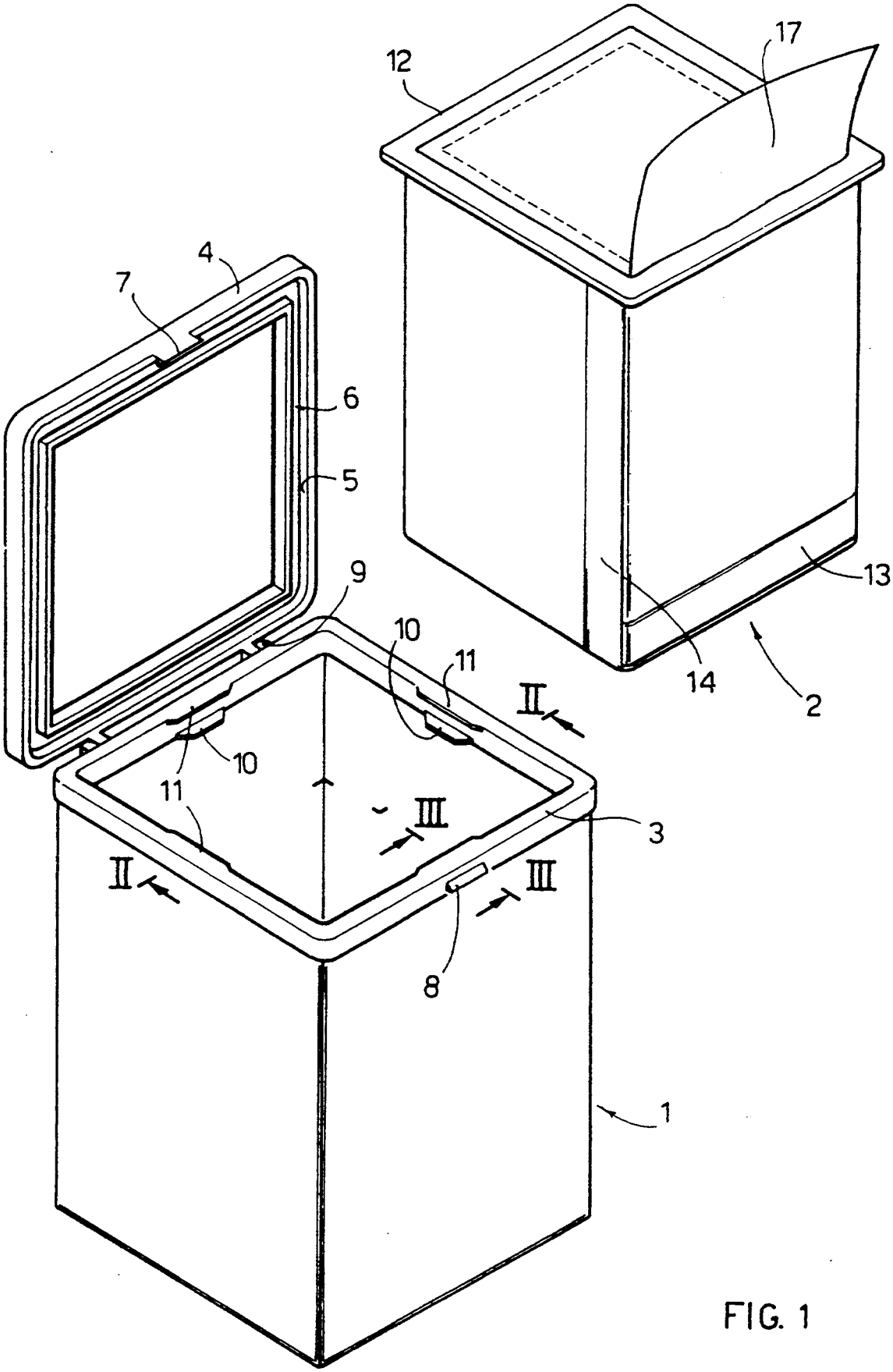
FIG. 1 is an exploded axonometric view of the rigid container according to the invention and of a flexible pack able to be housed in the same.
Figure 2:
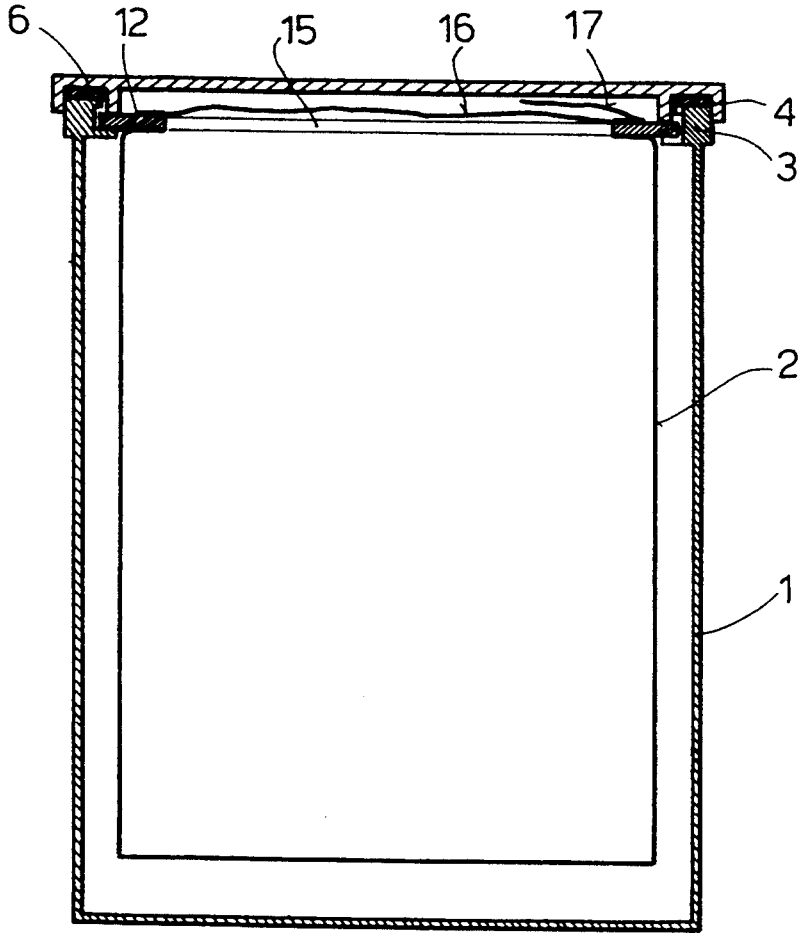
FIG. 2 is a section taken along the line II—II in FIG. 1, showing the pack inserted in the container, with the lid closed.
Figure 3:
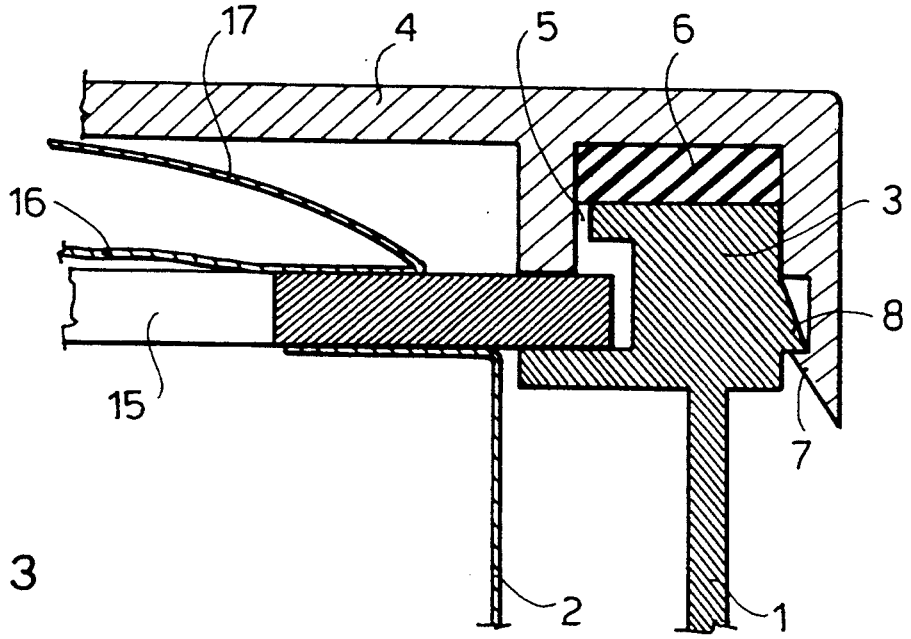
FIG. 3 is a highly enlarged section taken along the line III—III in FIG. 1, again with the pack inserted and the lid closed.

With reference to such figures, the rigid container according to the invention is shown with reference numeral 1, and an interchangeable pack which can be inserted into the container 1 with reference numeral 2.

The container 1 can be made of any suitable material whatsoever, as long as it is sufficiently rigid, for example cardboard, plastic material, metallic material, such as aluminium or the like.

The container consists of a parallelepiped-shaped box, open at the top, where it has a perimetral edge 3, on the outside of which a lid 4 is hinged, having an inner perimetral seat or channel 5, intended to house the edge 3 in the closing position. On the bottom of the seat 5 a gasket 6 is positioned to guarantee a tight seal. The closing is obtained by means of the engagement of a tooth 7, foreseen on the lid 4, with a corresponding tooth 8 on the edge 3, such teeth being positioned on the side opposite to the hinges 9.

In correspondence with the edge 3, a certain number of tabs 10 are foreseen (four in number with reference to the appended figures), protruding inside the container and serving to restrain a perimetral frame 12 of the pack 2, as will be described below.

Of course, only two tabs 10 may be foreseen, located on two opposite sides of the container, or a greater number of tabs than illustrated, without excluding the possibility of making a continuous projection on the inside of the container.

At a higher level than the tabs 10, other tabs 11 of lesser "depth" are foreseen, serving to block the frame 12 of the pack 2, by preventing it coming out.

The pack 2, merely for the sake of example, is a vacuum or gas compensated pack of a product in powder form, and is parallelepiped-shaped with dimensions which, when the pack is under vacuum, are smaller than the distances between the opposed tabs 10 which are foreseen on the inside of thee container 1.

The pack 2 is conveniently made of flexible material, with a one-layer or multilayer film, for example with a process described in the Italian Patent application MI 91 A 001770 quoted above, in such a way as to have a horizontal folding edge 13 on one of its walls, and two folding edges 14 (only one visible in FIG. 1) on the walls adjacent to the first. The Italian Patent application quoted foresees the provision of a lower rigid plate and of an upper rigid plate by thermowelding, to give the pack the consistency of a rigid pack, even after it has been opened. In this case, this is not necessary, and therefore only the said perimetral frame 12 is provided in correspondence with the upper face of the pack, determining a wide opening 15, which is closed by a peal-off diaphragm 16, provided with a grasping flap 17.

The pack 2 described in the appended drawings, although preferred, is not to be considered restrictive since other packs which substantially have the same shape can be used.

The container 1 is marketed together with a pack 2 already inserted in it. The packs 2 can also be foreseen as refills for the rigid container 1.

During use, the pack 2 is inserted from the top of the container 1, until its perimetral frame 12 passes beyond the tabs 11, coming into position on the support tabs 10, which stop it "sinking" any further into the container 1. On the other hand, the upper tabs 11 prevent the pack 2 possibly coming out by accident, and they serve to keep the pack in position better.

When the pack 2 is opened, the loss of vacuum causes it to swell and tend to conform to the inner walls of the container 1.

From what has been explained above, the advantages of the container according to the invention, especially from the practical and economical point of view, are very clear to see.

I claim:

1. A rigid container comprising:

an interchangeable flexible pack; and a substantially parallelepiped-shaped box comprising:

an upper edge comprising a plurality of means for supporting the interchangeable flexible pack and a plurality of means for blocking the interchangeable flexible pack and a closable lid wherein the interchangeable flexible pack has a parallelepiped-shape that will fit in the box and comprises a plurality of means for engaging with the means for supporting and the means for blocking.

2. A rigid container according to claim 1 wherein the means for supporting the interchangeable flexible pack comprise at least one pair of opposed tabs protruding inside the box that are suitable for supporting a perimetral frame located on an upper face of the interchangeable flexible pack.

3. A rigid container according to claim 1 wherein the means for blocking the interchangeable flexible pack comprise blocking tabs protruding inside the box and positioned at a higher level than the means for supporting the interchangeable flexible pack so that the blocking tabs can be passed over by a frame of the interchangeable flexible pack which comprises the means for engaging when the interchangeable flexible pack is inserted into the box.

4. A rigid container according to claim 1, wherein the closable lid is hinged to the upper edge of the box and has an inner perimetral channel suitable for receiving the upper edge of the box when the lid is in a closed position.

5. A rigid container according to claim 4 wherein a sealing gasket is positioned on a bottom of the inner perimetral channel.

6. A rigid container according to claim 1 wherein the interchangeable flexible pack comprises a flexible film comprising a first fold on a first parallelepiped side a second fold, substantially perpendicular to the first fold, on a second parallelepiped side and a third fold, substantially perpendicular to the first fold, on a third parallelepiped side, the second parallelepiped side and the third parallelepiped side being adjacent first parallelepiped side.

7. A rigid container according to claim 1 wherein the interchangeable flexible pack is a vacuum pack and contains a product in powder form.

8. A rigid container according to claim 1 wherein the box is made of at least one material selected from the group consisting of cardboard, plastic the metal.

9. A rigid container according to claim 2 wherein the means for blocking the interchangeable flexible pack comprise blocking tabs protruding insider the box and positioned at a higher level than the at least one pair of opposed tabs so that the blocking tabs can be passed over by a frame of the interchangeable flexible pack which comprises the means for engaging when the interchangeable flexible pack is inserted into the box.

10. A rigid container according to claim 2 wherein the closable lid is hinged to the upper edge of the box and has an inner perimetral channel suitable for receiving the upper edge of the box when the lid is in a closed position.

11. A rigid container according to claim 3 wherein the closable lid is hinged to the upper edge of the box and has an inner perimetral channel suitable for receiving the upper edge of the box when the lid is in a closed position.

12. A rigid container according to claim 2 further comprising a peel-off diaphragm is foreseen with a grasping flap, the peel-off diaphragm being attached to an upper surface of the perimetral frame.

13. A rigid container according to claim 9 further comprising a peel-off diaphragm is foreseen with a grasping flap, the peel-off diaphragm being attached to an upper surface of the perimetral frame.

14. A rigid container according to claim 10 further comprising a peel-off diaphragm is foreseen with a grasping a flap, the peel-off diaphragm being attached to an upper surface of the perimetral frame.

15. A rigid container according to claim 2 wherein the interchangeable flexible pack comprises a flexible film comprising a first fold on a first parallelepiped side a second fold, substantially perpendicular to the first fold, on a second parallelepiped side and a third fold, substantially perpendicular to the first fold, on a third parallelepiped side, the second parallelepiped side and the first parallelepiped side being adjacent the first parallelepiped side.

16. A rigid container according to claim 15 further comprising a peel-off diaphragm is foreseen with a grasping flap, the peel-off diaphragm being attached to an upper surface of the perimetral frame.

17. A rigid container according to claim 3 wherein the interchangeable flexible pack comprises a flexible film comprising a first fold on a first parallelepiped side a second fold, substantially perpendicular to the first fold, on a second parallelepiped side and a third fold, substantially perpendicular to the first fold, on a third parallelepiped side, the second parallelepiped side and the third parallelepiped side being adjacent the first parallelepiped side.

18. A rigid container according to claim 4 wherein the interchangeable flexible pack comprises a flexible film comprising a first fold on a first parallelepiped side a second fold, substantially perpendicular to the first fold, on a second parallelepiped side and a third fold, substantially perpendicular to the first fold, on a third parallelepiped side, the second parallelepiped side and the third parallelepiped side being adjacent the first parallelepiped side.

19. A rigid container according to claim 5 wherein the interchangeable flexible pack comprises a flexible film comprising a first fold on a first parallelepiped side a second fold, substantially perpendicular to the first fold, on a second parallelepiped side and a third fold, substantially perpendicular to the first fold, on a third parallelepiped side, the second parallelepiped side and the third parallelepiped side being adjacent the first parallelepiped side.

* * * * *